US010890418B2

(12) United States Patent
Knezek et al.

(10) Patent No.: US 10,890,418 B2
(45) Date of Patent: Jan. 12, 2021

(54) VESSEL BARRIER SYSTEM WITH ENERGY DISSIPATING UNIT

(71) Applicant: Truston Technologies, Inc., Annapolis, MD (US)

(72) Inventors: Erick Knezek, Lafayette, LA (US); Matt Marcy, Bluemont, VA (US); William Stuart, Houston, TX (US)

(73) Assignee: OCEANETICS, INC., Annapolis, MD (US)

( * ) Notice: Subject to any disclaimer, the term of this patent is extended or adjusted under 35 U.S.C. 154(b) by 0 days.

(21) Appl. No.: 16/603,877

(22) PCT Filed: Apr. 9, 2018

(86) PCT No.: PCT/US2018/026768

§ 371 (c)(1),
(2) Date: Oct. 9, 2019

(87) PCT Pub. No.: WO2018/191191

PCT Pub. Date: Oct. 18, 2018

(65) Prior Publication Data

US 2020/0116458 A1 Apr. 16, 2020

Related U.S. Application Data

(60) Provisional application No. 62/483,934, filed on Apr. 10, 2017.

(51) Int. Cl.
*F41H 11/05* (2006.01)
*E02B 3/20* (2006.01)

(52) U.S. Cl.
CPC ..... *F41H 11/05* (2013.01); *E02B 3/20* (2013.01)

(58) Field of Classification Search
CPC combination set(s) only.
See application file for complete search history.

(56) References Cited

U.S. PATENT DOCUMENTS 3,010,284 A * 11/1961 Buzzell ..... E02C 1/10 405/85
6,681,709 B1 * 1/2004 Nixon ..... B63G 9/04 114/240 C (Continued)

FOREIGN PATENT DOCUMENTS

GB 1602512 A * 11/1981 ..... E02B 3/20

*Primary Examiner* — Kyle Armstrong
(74) *Attorney, Agent, or Firm* — Law Office of Jesse D. Lambert, LLC

(57) ABSTRACT

A vessel barrier system to prevent vessel movement through a passageway includes a flexible vessel barrier element coupled to one or more energy dissipating units. The vessel barrier element may be a single, typically large diameter element, for example a large diameter, high strength synthetic rope, or alternatively may be a barrier net suspended on a number of floats. The vessel barrier element is coupled by a cable to the energy dissipating unit(s), which may be large weights suspended from a frame. When a vessel contacts and moves the vessel barrier element, placing it in tension, the weights are moved from a first, lower position, to a second, elevated position. The kinetic energy of the vessel is transferred to an increase in the potential energy of the weights, and the vessel is brought to a stop. The system is particularly suitable for Large Displacement Vessels or LDVs.

7 Claims, 6 Drawing Sheets

(56) References Cited

U.S. PATENT DOCUMENTS

| | | | | |
|---|---|---|---|---|
| 2012/0076590 | A1* | 3/2012 | Bruder | E02B 3/20 405/214 |
| 2016/0002975 | A1* | 1/2016 | Knezek | F41H 11/05 405/71 |
| 2017/0370061 | A1* | 12/2017 | James | E02B 3/20 |

* cited by examiner

VESSEL BARRIER SYSTEM WITH ENERGY DISSIPATING UNIT

CROSS REFERENCE TO RELATED APPLICATIONS

This non-provisional patent application claims priority to U.S. provisional patent application Ser. No. 62/483,934, filed Apr. 10, 2017, for all purposes.

BACKGROUND

Field of the Invention

This invention relates to a system and apparatus for stopping the movement of large, ocean going vessels, namely vessel barrier systems. Such vessels may be referred to at times as Large Displacement Vessels or "LDVs." Barrier systems are required not only for stopping attempted intentional vessel entry into (or exit from) protected areas, e.g. harbors and the like; but also unintentional vessel passage into or out of protected areas, for example from drifting due to loss of steerage, power, etc.

The simplest of vessel barrier systems are fixed barriers, ranging from banks of stone or earth, fixed pilings, etc. However, such systems will frequently result in tremendous damage to any vessel striking them. Various floating vessel barrier systems (which can be readily easily put into place and removed if necessary) have been developed to stop passage of relatively smaller vessels. The kinetic energy of the moving vessel is transferred to and absorbed by the barrier, for example a line of connected floating barrier units connected by cables, netting, etc. Preferably, the vessel is not damaged due to contact with such floating barrier units.

However, very large ocean going vessels or LDVs, for example cruise ships, have tremendous kinetic energy, too much to be readily absorbed or dissipated by known prior art floating vessel barrier systems and thereby bring the LDV to a halt. By way of example, an LDV moving at 3.00 meters/second may possess a kinetic energy value of approximately 348 Megajoules, far too much for an LDV to be contained by known prior art barrier systems.

As such, the known prior art barrier systems of this type all present various issues for such applications, giving rise to a desire for a vessel barrier system that addresses these issues.

SUMMARY OF THE INVENTION

The vessel barrier system embodying the principles of the present invention comprises a length of flexible vessel barrier elements, which may comprise a length of large diameter synthetic rope, cable, or chain, or a variety of other structures, for example a net system suspended by a number of floating barrier units joined by cables, etc. One commercially available system is know as Port Security Barriers or PSBs.

In addition to the vessel barrier elements, the vessel barrier system embodying the principles of the present invention comprises one or more energy dissipating units connected to the vessel barrier elements. The energy dissipating units, in a presently preferred embodiment, comprise large weights which are connected to the vessel barrier elements by a cable and pulley system. When a moving vessel contacts and displaces the vessel barrier elements, the weights are raised from a first, lower position, to a second, elevated position, thereby converting or transferring the kinetic energy of the moving vessel to potential energy in the elevated weights. In the process, the vessel is brought to a halt, by a combination of energy transfer/dissipation in the elevated weights, elasticity in the vessel barrier elements, and other elements of the overall vessel barrier system.

DESCRIPTION OF THE PRESENTLY PREFERRED EMBODIMENT(S)

While various vessel barrier systems can embody the principles of the present invention, with reference to the drawings some of the presently preferred embodiments can be described.

Figure 1:
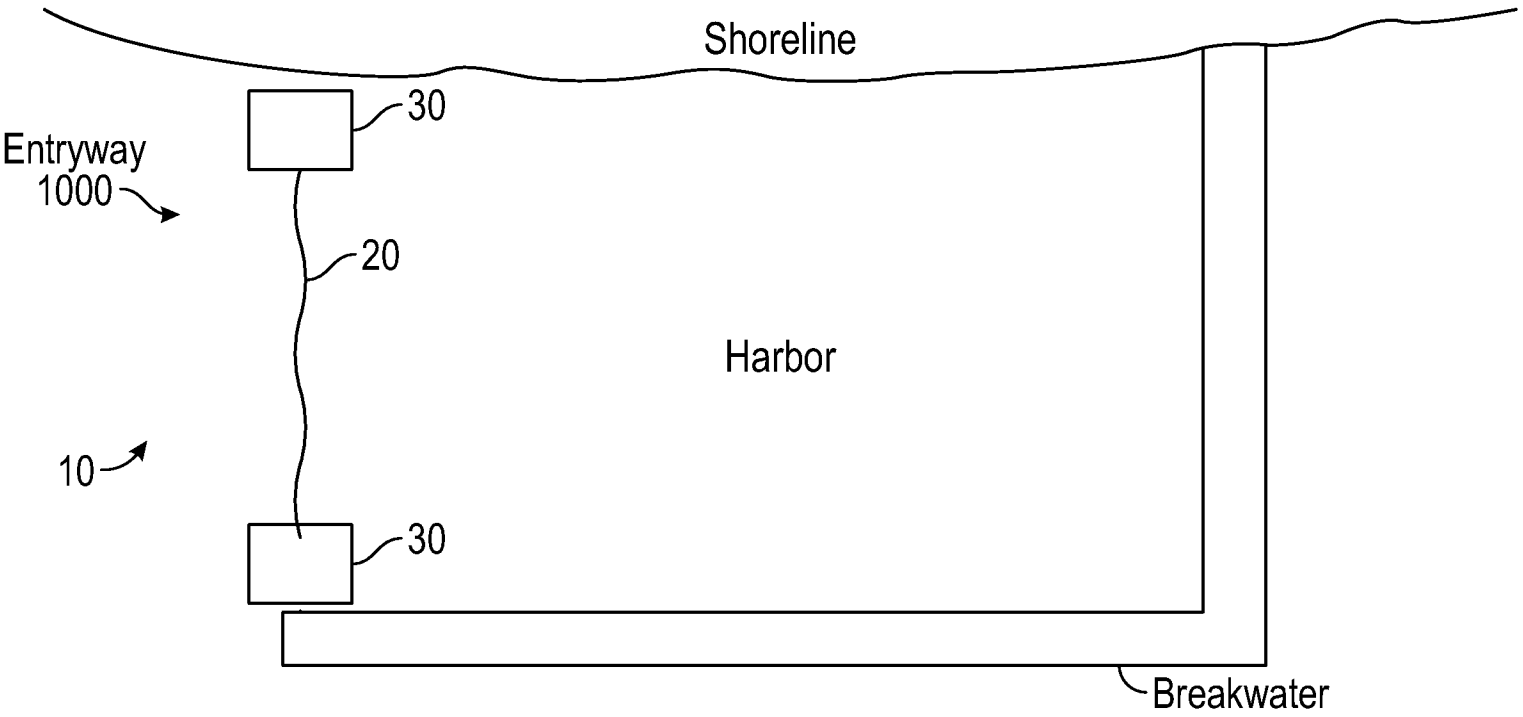
FIG. 1 is a top view of an exemplary setting for use of the vessel barrier system embodying the principles of the present invention, depicting a harbor setting and showing various elements of the system.

FIG. 1 is a top view showing an exemplary setting for use of the vessel barrier system of the present invention. A harbor formed by man made or natural elements provides a partially enclosed area for vessels, including but not limited to LDVs. A breakwater forms (for example) a partial enclosed harbor, with an opening or passageway permitting allowing vessels to enter/leave the harbor. A vessel barrier system 10 may be positioned across the passageway to control ingress and egress to a waterbody, in this example to prevent intentional or accidental vessel entry into or exit from the harbor. It is to be understood that vessel barrier system 10 could be placed in many other settings, for example across a river, canal, etc.

Figure 2:
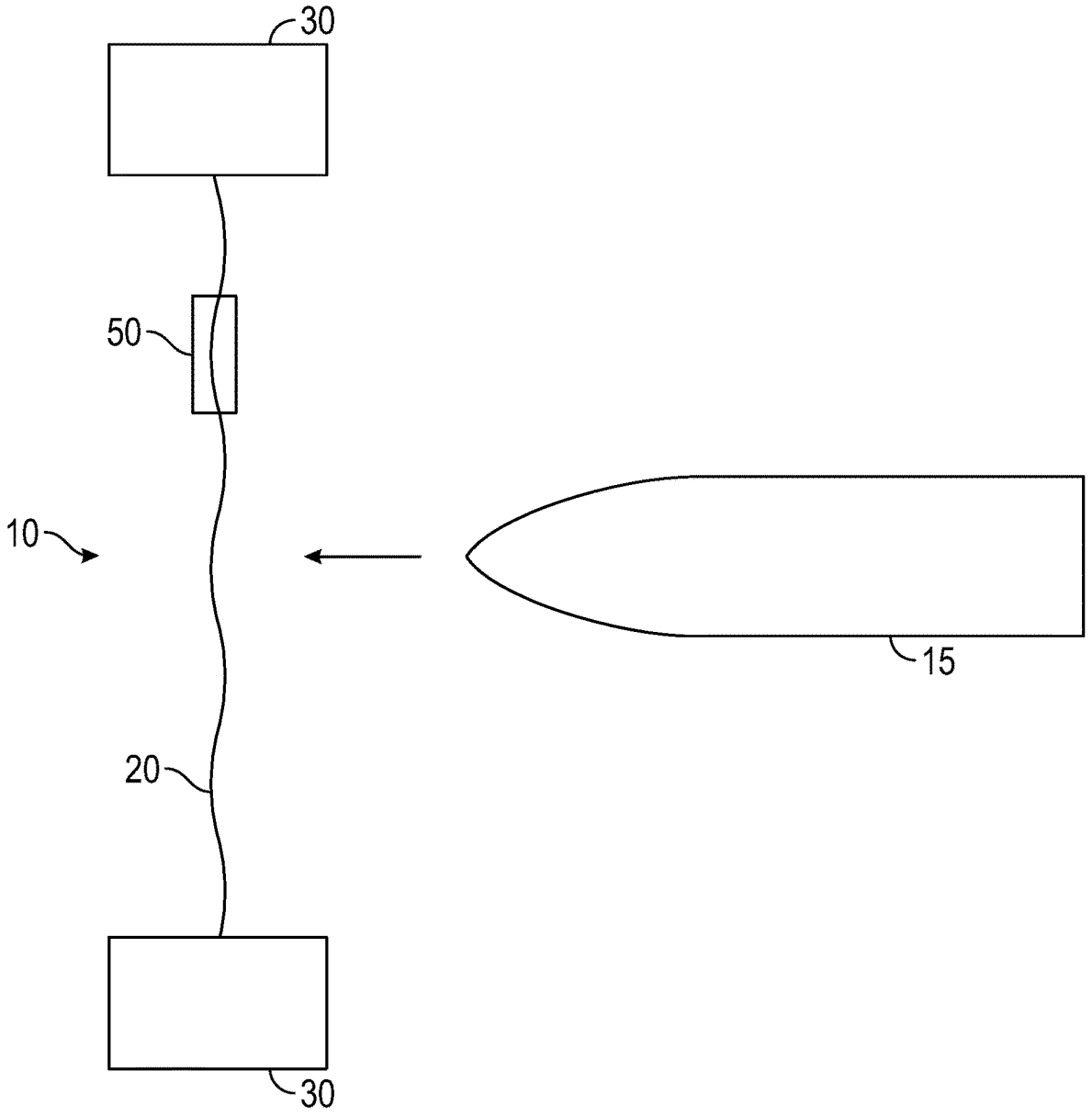
FIG. 2 is a top schematic view of the vessel barrier system embodying the principles of the present invention, prior to contact by a moving vessel.

FIG. 2 is a top view, in simplified form, of an embodiment of the vessel barrier system 10. Broadly, in a presently preferred embodiment, a vessel barrier element 20 runs between two energy dissipating units 30 and is operatively coupled to energy dissipating units 30. It is understood that in certain embodiments, one end of vessel barrier element 20 could be attached to a fixed point, e.g. a stationary piling or other structure, with only the other end of vessel barrier element 20 coupled to an energy dissipating unit 30 (that is, only a single energy dissipating unit 30 being used). FIG. 2 additionally shows a vessel 15 moving in the direction of the vessel barrier element 20, but not yet in contact therewith; hence, vessel barrier element 20 is in a generally non-tensioned state.

Fundamentally, vessel barrier system 10 transfers the kinetic energy of a large, moving vessel 15 (which may be an LDV) coming into contact with vessel barrier element 20, to one or more energy dissipating units 30, and in the process brings the moving vessel to a stop.

Figure 3:
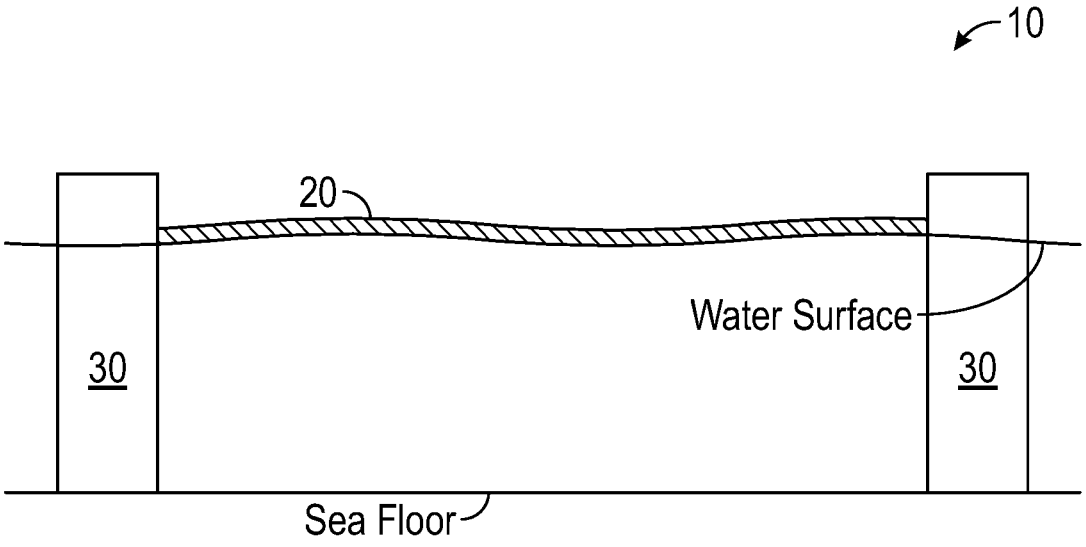
FIG. 3 is a view of one embodiment of the vessel barrier system, from the perspective of a vessel approaching the system.
Figure 4:
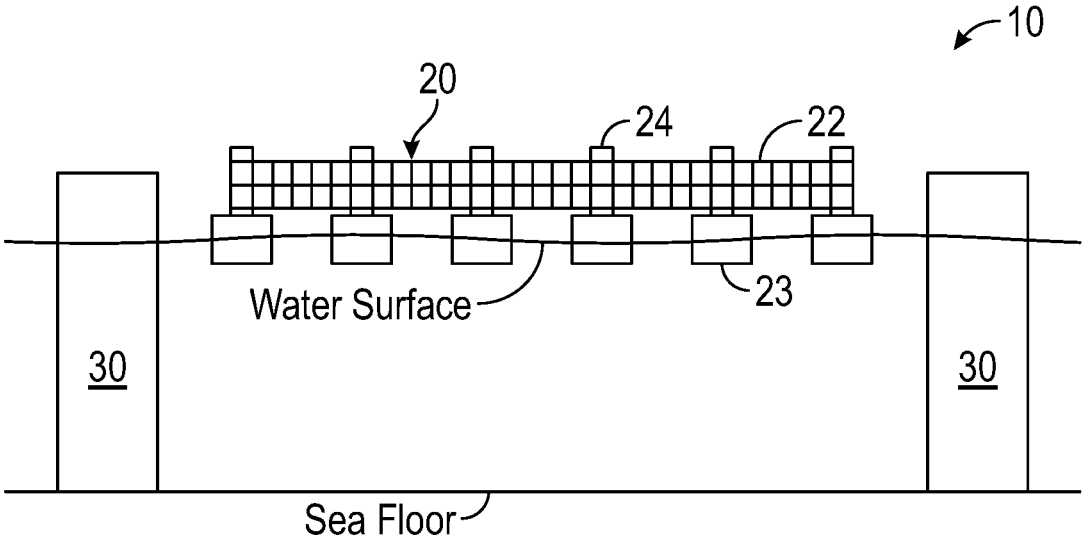
FIG. 4 is a view of another embodiment of the vessel barrier system, from the perspective of a vessel approaching the system.

FIGS. 3 and 4 are views of two possible embodiments of vessel barrier element 20 from the perspective of a vessel approaching the system, also showing a cross section through the water column. Generally, vessel barrier element 20 is a flexible element running between energy dissipating units 30. FIG. 3 shows a single, typically relatively large diameter flexible member, for example a large rope, which would preferably be of a synthetic material such as polyethylene. In FIG. 3, the single member vessel barrier element 20 is shown positioned substantially at the surface of the water. Other synthetic materials, such as kevlar, polypropylene, etc. could also be used. In addition, vessel barrier element 20 could be a steel or similar material cable, possibly supported by one or more buoys to hold at least a portion of it at a desired spacing from the water's surface. FIG. 4 shows another embodiment of vessel barrier element 20, namely an arrangement of barrier net 22, supported by a plurality of floats 23, with vertical members 24 supported by the floats. Such arrangement is commercially available as Port Security Barriers or "PSBs." Generally, barrier net 22 comprises large diameter lines and composite netting with associated thimbles and eyes, typically made of a synthetic material such as nylon. Barrier net 22, along with any PSB used to support same, are designed to accommodate specific barrier loads expected, with appropriate safety factors. Whether a single rope, net, or any other arrangement, vessel barrier element 20 is operatively coupled to energy dissipating unit 30, as later described.

It is to be understood that the scope of the present invention encompasses any vessel barrier element of sufficiently flexibility to be coupled to the energy dissipating unit(s), to receive a moving vessel, and to transfer the kinetic energy of the moving vessel to the energy dissipating units.

Figure 5:
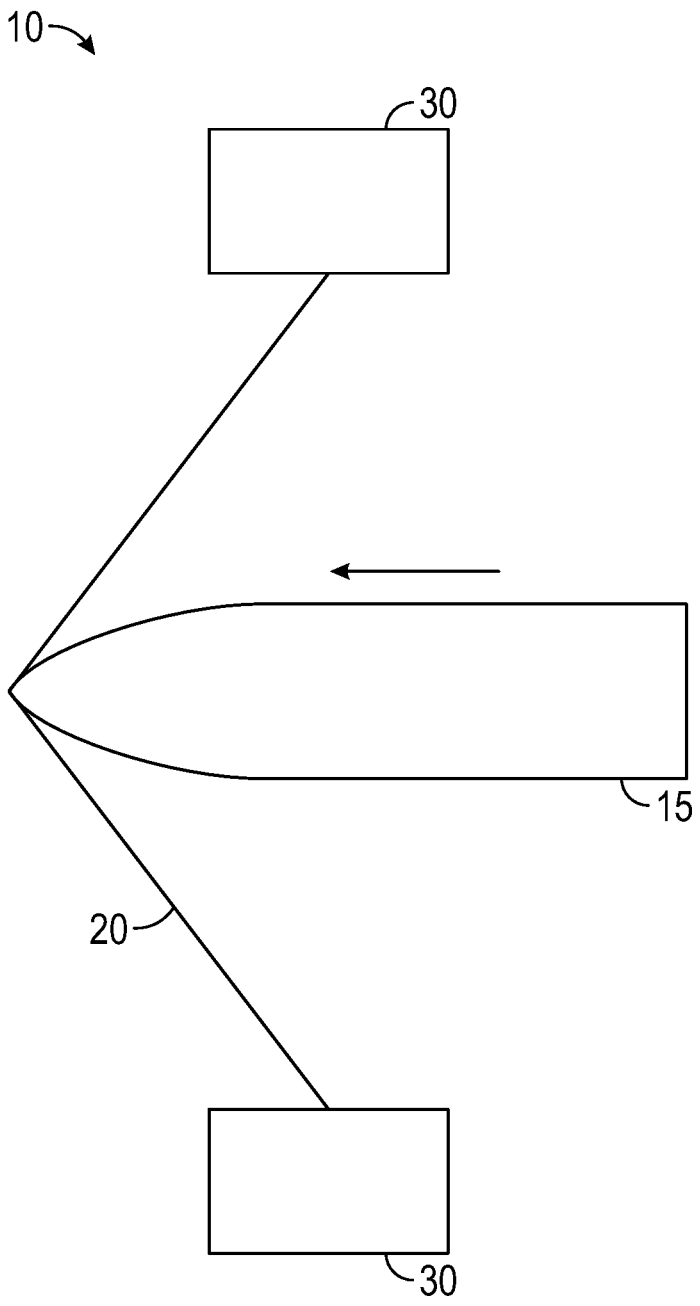
FIG. 5 is a top schematic view of an embodiment of the vessel barrier system of FIG. 2, showing a vessel in contact with the vessel barrier elements and brought to a stop.

FIG. 5 shows vessel barrier system 10 with a moving vessel 15 coming into contact with and captured by vessel barrier element 20; hence, vessel barrier element 20 is displaced and tensioned by contact with vessel 15. By way of example, FIG. 5 may show the position of the vessel and the system with the vessel brought to a stop, and the vessel barrier element 20 at its final position. As described above, it is to be understood that vessel barrier element 20 is coupled to one or more energy dissipating units 30, and some or all of the kinetic energy of the moving vessel is therefore transferred through vessel barrier element 20 to the energy dissipating unit(s) 30.

Figure 6:
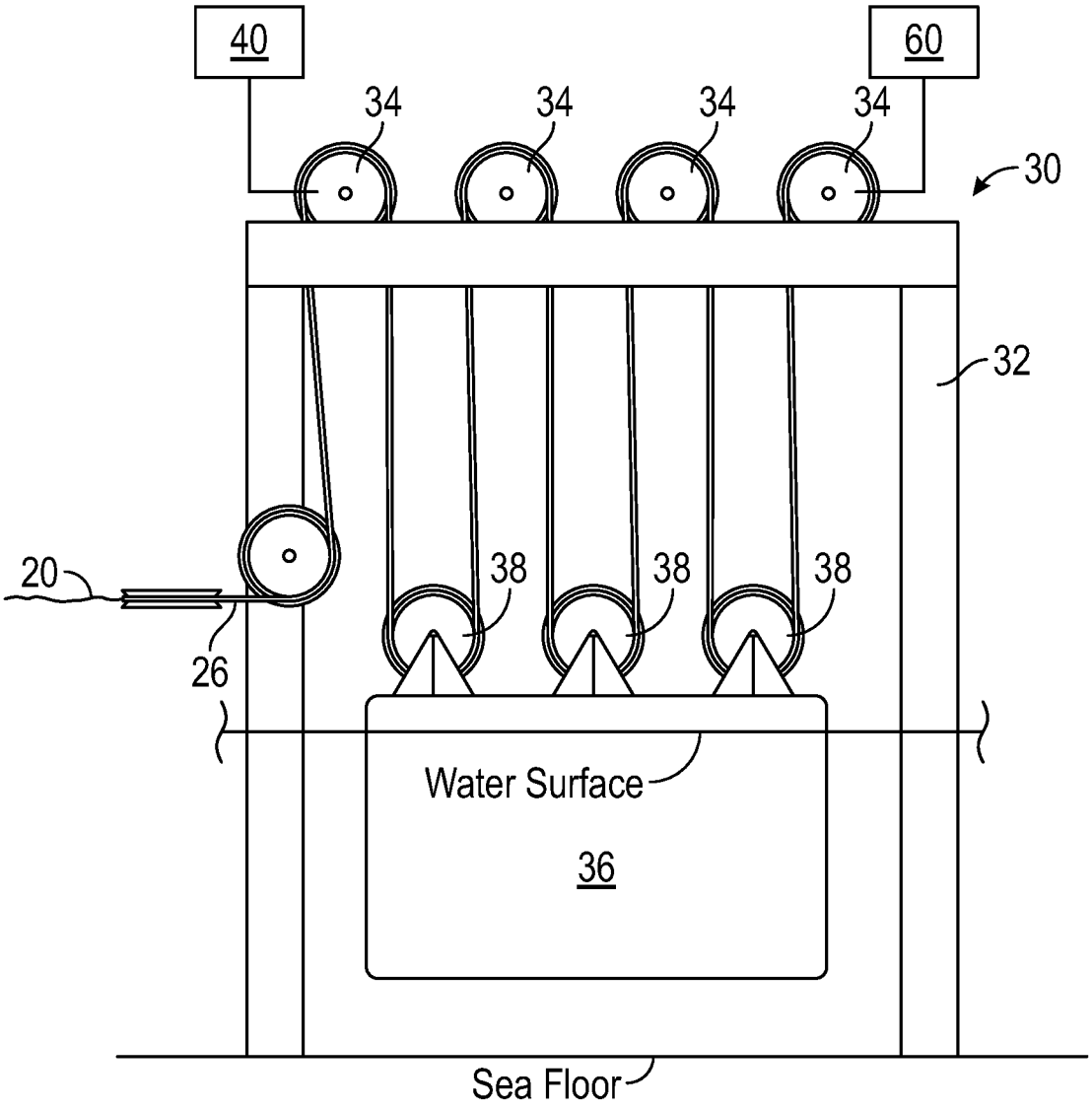
FIG. 6 is a view of an embodiment of an energy dissipating unit of the present invention, with the weights in a first (lower) position.
Figure 7:
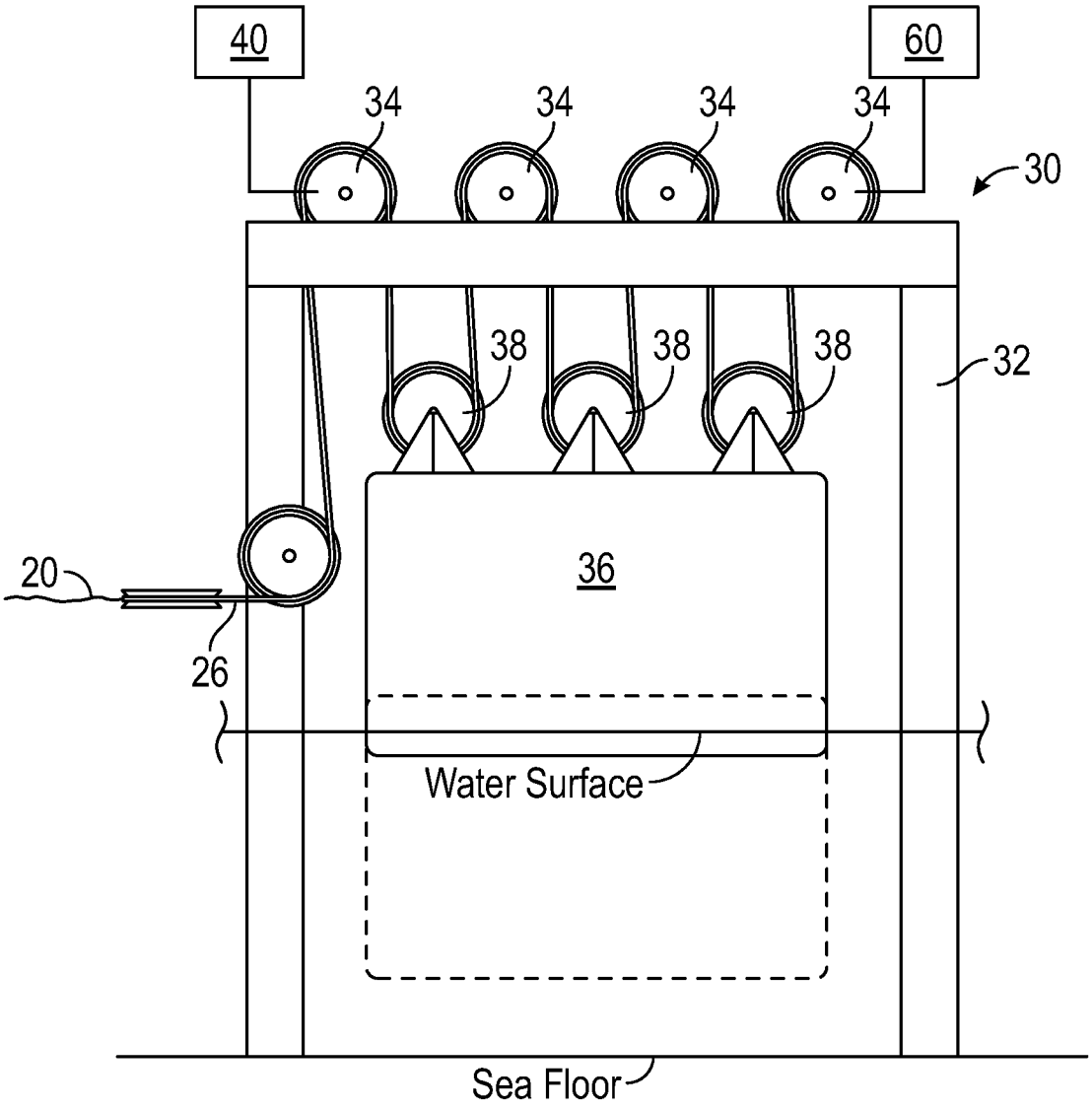
FIG. 7 is a view of an embodiment of an energy dissipating unit of the present invention, with the weights in a second (raised) position, as the result of a moving vessel stopped by the vessel barrier elements.

FIGS. 6 and 7 show one energy dissipating unit 30 embodying the principles of the present invention. Vessel barrier element 20 is coupled to energy dissipating unit 30 by a flexible member, e.g. cable 26. A frame 32 supports one or more pulleys 34. A weight 36 is suspended from frame 32 via cable 24, typically by a plurality of pulleys 38 on weight 36. It is understood that any number of pulleys 34 and 38 on frame 32 and weight 36 may be used. Tension on cable 26 (due to a vessel being captured by vessel barrier element 20) of sufficient magnitude lifts weight 36 from a first, lowered position, as in FIG. 6, to a second, elevated position, as shown in FIG. 7. FIG. 7 shows the first, lowered position of weight 36 in phantom lines. As previously described, the kinetic energy of the moving vessel is transferred to, and results in, the change in potential energy of the weight 36. It is understood that a certain amount of the kinetic energy of the moving vessel is lost in other aspects of the system, e.g. drag of the barrier elements in the water, friction of the cable and pulleys, etc. As previously noted, vessel barrier system 10 may comprise two energy dissipating units 30, namely one at each end of vessel barrier element 20; or alternatively may comprise only a single energy dissipating unit 30, or even more than two energy dissipating units 30.

Once vessel 100 has been stopped, it is desirable to have weight 36 restrained from rapidly dropping back to its initial position and thereby "slingshot" the vessel backward from vessel barrier element 20. A braking unit 40, represented schematically in FIGS. 6 and 7, is preferably operatively coupled to energy dissipating unit 30 to restrain weight 36 from rapidly falling from it's the second, elevated position back to its first, lowered position. Once vessel 100 is moved out of engagement with vessel barrier element 20, weight 36 can be lowered in a controlled fashion. Braking unit 40 may take a number of forms known in the relevant art, including some combination of hydraulic dampener, drum brake, or any other means of controlling movement of weight 36 and either maintaining it in its elevated position, or alternatively lowering it in a controlled fashion. Energy dissipating unit 30 further comprises a tensioning unit 60, represented schematically in FIGS. 6 and 7. Tensioning unit 60 keeps a low tension in the cable system as tide levels raise and lower weight 36. This prevents slack from developing in the vessel barrier system 10 at high tide.

Weight 36 may be any object with sufficient weight to offset the expected kinetic energy of vessel 15. Weight 36 may be a large concrete block, or may be a container or barge filled with a weighting material, e.g. metal, water, etc.

METHOD(S) OF USE OF THE VESSEL BARRIER SYSTEM

The vessel barrier system embodying the principles of the present invention can be deployed in a number of settings, to provide a means to stop vessel passage through a passage. Referring to FIG. 1, entryway 1000 may be an entry into a port, harbor or the like; or alternatively may be a passage along a waterway such as river or the like, where natural or manmade obstacles form a limited passage.

The movement of a subject vessel may be intentional or due to drifting from loss of power or steerage. Preferably, vessel barrier element 20 is of such configuration that the vessel will not be materially damaged by contact with vessel barrier element 20. The dimensions of all components of the system may be changed as needed to accommodate particular settings, expected vessels, etc.

By way of example, a subject vessel 15 may have a mass of approximately 77000 tons. With an assumed velocity at the time of encountering vessel barrier element 20 of 3 meters/second, vessel 15 possesses a kinetic energy of approximately 350 megajoules. This represents the approximate energy that must be absorbed/dissipated by vessel barrier system 10.

Various design parameters may be optimized to keep the stopping distance (i.e. the distance that vessel 15 travels after first contacting vessel barrier element 20) to a desired value, for example 100 meters or less; and to keep vessel barrier element tension values within a desired value, e.g. 900 metric tons. In particular for vessel barrier elements 20 comprising a net, the design of the net can be optimized to broadly distribute the expected load on the bow (or other vessel surface) in order to minimize damage to the hull.

If desired, one or more gates 50 (represented schematically in FIG. 2) can be incorporated into vessel barrier element 20. Such gates can be opened and closed by manual efforts (i.e. moving the gate section via another, typically smaller service vessel), or some embodiment of automated/remote control system may be used.

As noted above, materials for the vessel barrier element may advantageously comprise synthetic materials such as nylon, high strength plastics and composites, etc., all of which are resistant to deterioration in a marine environment. Energy dissipating unit 30, or parts thereof, may be fabricated from high strength metals, including those resistant to corrosion. Weight 36 may comprise any relatively dense object or material which will yield the desired change in potential energy within the available elevation change.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions of the various elements of the vessel barrier system can be altered to suit particular settings and/or to accommodate particular vessels, expected vessel velocities, etc.; materials can be changed to suit particular marine environments; etc.

Therefore, the scope of the invention is to be determined not by the illustrative examples set forth above, but by the appended claims and their legal equivalents.

We claim:

1. A vessel barrier system, comprising:

a vessel barrier element, comprising a flexible element adapted to receive a moving vessel; and at least one energy dissipating unit coupled to said vessel barrier element, whereby kinetic energy of a moving vessel contacting said vessel barrier element is transferred to and dissipated by said energy dissipating unit whereby said kinetic energy of said moving vessel is converted into potential energy; and wherein said at least one energy dissipating unit comprises a weight coupled to said vessel barrier element, said weight movable between a first, lowered position, when said vessel barrier element is in its first, relaxed position, and a second, raised position, when said vessel barrier element is in a second, tensioned position due to a vessel moving said vessel barrier element, said weight being of sufficient magnitude to bring said moving vessel to a stop when said weight reaches said second, raised position.

2. The vessel barrier system of claim 1, wherein said weight is coupled to said vessel barrier element by a cable and pulley system, and further comprising a brake whereby said weight is prevented from rapid falling to said first, lowered position after forces from said vessel have been removed from said vessel barrier element.

3. The vessel barrier system of claim 2, whereby said vessel barrier element comprises a large diameter cable.

4. The vessel barrier system of claim 2, whereby said vessel barrier element comprises a barrier net system, said barrier net system comprising a net positioned at a surface of a waterbody by a plurality of floats and support members.

5. The vessel barrier system of claim 1, further comprising an openable gate disposed in said vessel barrier element.

6. A vessel barrier system for controlling ingress and egress to a waterbody, comprising:

a vessel barrier element, comprising a net positioned at the surface of said waterbody and across a passageway, said net supported by a plurality of floats and support members;

at least one energy dissipating unit operatively coupled to said vessel barrier element, said energy dissipating unit comprising a frame supporting a weight movable from a first, lower position to a second, elevated position;

whereby said vessel barrier element is operatively coupled to said at least one energy dissipating unit by a cable running through a plurality of pulleys on said frame and said weight, and wherein said weight is movable in response to a tension on said vessel barrier element by a vessel contacting said vessel barrier element and displacing said vessel barrier element, wherein said weight is of sufficient magnitude to bring said vessel to a stop when said weight is moved to said second, elevated position;

further comprising a brake operatively coupled to said energy dissipating unit, whereby said weight is prevented from rapid fall from said second, elevated position to said first, lower position.

7. The vessel barrier system of claim 6, wherein said weight of said at least one energy dissipating unit, and said vessel barrier element, are sized and dimensioned to stop a Large Displacement Vessel (LDV).

* * * * *